US006648437B2

(12) United States Patent
Kawamura et al.

(10) Patent No.: US 6,648,437 B2
(45) **Date of Patent: *Nov. 18, 2003**

(54) FLUID EJECTION DEVICE AND METHOD OF FLUID EJECTION

(75) Inventors: Naoto Kawamura, Corvallis, OR (US); Marvin G. Wong, Woodland Park, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 183 days.

This patent is subject to a terminal disclaimer.

(21) Appl. No.: 09/938,694

(22) Filed: Aug. 23, 2001

(65) Prior Publication Data

US 2002/0030720 A1 Mar. 14, 2002

Related U.S. Application Data

(63) Continuation of application No. 09/556,026, filed on Apr. 20, 2000, now abandoned, which is a continuation-in-part of application No. 09/430,534, filed on Oct. 29, 1999, now Pat. No. 6,188,414.

(51) Int. Cl.[7] ..... B41J 25/308; B41J 2/05
(52) U.S. Cl. ..... 347/8; 347/58; 347/63
(58) Field of Search ..... 347/8, 40–42, 347/50, 58

(56) References Cited

U.S. PATENT DOCUMENTS

| | | | | | |
|---|---|---|---|---|---|
| 4,622,574 A | | 11/1986 | Garcia | | |
| 4,730,197 A | * | 3/1988 | Raman et al. | ..... | 347/40 |
| 4,734,717 A | | 3/1988 | Rayfield | | |
| 4,873,622 A | * | 10/1989 | Komuro et al. | ..... | 347/50 |
| 4,940,413 A | | 7/1990 | Childers et al. | | |
| 5,389,962 A | | 2/1995 | Sekiya et al. | | |
| 5,694,684 A | | 12/1997 | Yamamoto | | |
| 5,852,456 A | * | 12/1998 | Okada et al. | ..... | 347/71 |
| 6,039,439 A | | 3/2000 | Komplin et al. | | |
| 6,099,109 A | * | 8/2000 | Komuro | ..... | 347/50 |
| 6,188,414 B1 | * | 2/2001 | Wong et al. | ..... | 347/42 |
| 6,290,340 B1 | * | 9/2001 | Kitahara et al. | ..... | 347/70 |
| 6,554,409 B2 | * | 4/2003 | Ishii | ..... | 347/71 |

FOREIGN PATENT DOCUMENTS

| | | |
|---|---|---|
| EP | 0593175 A2 | 4/1994 |
| EP | 0646466 A2 | 4/1995 |
| WO | WO 99/65690 | 12/1999 |
| WO | WO 99/65691 | 12/1999 |

* cited by examiner

*Primary Examiner*—Stephen D. Meier
*Assistant Examiner*—Michael S Brooke

(57) ABSTRACT

A fluid ejection device capable of ejecting fluid onto media. The device includes a carrier having an upper surface that defines a recess. The device further includes a fluid ejecting substrate disposed therein that is configured for establishing electrical and fluidic coupling with the carrier. The fluid ejecting substrate has a generally planar orifice layer defining a plurality of orifices therein and a generally planar contact surface positioned below the orifice layer. The device further includes an encapsulant that at least partially encapsulates the fluid ejecting substrate and the carrier to form a substantially co-planar surface with the orifice layer.

16 Claims, 10 Drawing Sheets

FLUID EJECTION DEVICE AND METHOD OF FLUID EJECTION

CROSS REFERENCE TO RELATED APPLICATIONS

This is a continuation of copending application Ser. No. 09/556,026 filed on Apr. 20, 2000, now abandoned which is hereby incorporated by reference herein.

This invention is a continuation in part of U.S. patent application Ser. No. 09/430,534 filed on behalf of Marvin Wong, et al., on Oct. 29, 1999 now U.S. Pat. No. 6,188,414 entitled "Inkjet Printhead With Preformed Substrate" and assigned to the assignee of the present invention, the entire contents of which are incorporated herein by reference.

BACKGROUND OF THE INVENTION

This invention relates to inkjet printers, and more particularly to printing systems that include an inkjet printhead. Thermal inkjet printers have experienced a great deal of commercial success since their inception in the early 1980's. These printing systems have evolved from printing black text and graphics to full color, photo quality images. Inkjet printers are typically attached to an output device such as a computer. The output device provides printing instructions to the printer. These instructions typically are descriptions of text and images to be printed on a print media. A typical inkjet printer has a carriage that contains one or more printheads. The printhead and print media are moved relative to each other to accomplish printing.

The printhead typically consists of a fluid ejecting substrate which is electrically and fluidically coupled to the printing system. The fluid ejecting substrate has a plurality of heater resistors disposed therein which receive excitation signals from the printhead. The heater resistors are disposed adjacent a plurality of orifices formed in an orifice layer. Ink is supplied to the heater resistors from an ink source affixed to the printhead or from an ink source that is replaceable separate from the printhead. Ink supplied to the heater resistors is selectively ejected, in the form of ink droplets, through the orifices and onto the print media. The ink on the print media dries forming "dots" of ink that, when viewed together, create a printed image representative of the image description. The printed image is sometimes characterized by a print quality metric which may encompass dot placement, print resolution, color blending and overall appearance such as freedom from artifacts. Inkjet printer manufacturers are often challenged by an increasing need to improve print quality as well as increasing the reliability of the printhead.

The orifice layer and print media are ideally arranged in a parallel orientation to each other. An ink droplet ejected from an orifice in the orifice layer can be represented as a vector that is, ideally, directed orthogonal to the plane of the print media. Thus, when ink is ejected from the orifice layer of an "ideal printhead" the difference between where an ink droplet is placed on the print media and where it should have been placed is zero, thus the trajectory error is zero. In actuality, however, variations in the orifice layer manufacturing process result in ink droplets being ejected from an orifice at an angle which typically ranges between 0 and 2 degrees. These variations in the orifice layer are due to variation tolerances in the orifice formation as well as variation in the planarity of the orifice layer, to name a few.

The effect of trajectory error is exacerbated by separation distance between the printhead and print media. For example, a conventional printhead is separated from the print media by 1.5 mm. If ink is ejected from the orifice layer at an error angle of 2 degrees from the ideal or orthogonal direction, the ink droplet will be displaced 0.052 mm from where it should have been placed on the printing. If however, the printhead and print media are 0.7 mm apart and ink is ejected at the same 2 degree error angle, the ink droplet will be displaced by only 0.024 mm. This trajectory error tends to reduce or degrade the quality of the printed image because this error affects the positioning of ink on the print media.

The degradation in print quality resulting from trajectory error in conventional printheads is most prevalent where colors of ink are blended to produce "photographic" quality printed images. Here, displaced ink droplets will tend to cause the printed image to appear grainy and streaky. Furthermore, parasitic effects such as air current, tend to further influence trajectory error of the printing system. These parasitic effects tend to be reduced by lessening the printhead to print media spacing.

The printhead in a typical printing system is separated from the print media by a distance which may range from 1 millimeters to 1.5 millimeter (mm). This distance between the printhead and print media tends to be limited by the electrical coupling between the fluid ejecting substrate and the printhead body that supports the fluid ejecting substrate. For example, a disposable print cartridge includes a fluid ejecting substrate mounted in a pen body. An encapsulating material is often dispensed on top of the electrical coupling or interconnect to protect or shield the interconnect from ink. Inks used in thermal inkjet printheads tend to have salt constituents that tend to be corrosive and conductive. Once these inks leak into the electrical interface they tend to produce electrical shorts or corrosion that tend to reduce printhead life. The encapsulant disposed over the interconnect is commonly referred to as an encapsulant bead. The encapsulant bead protrudes beyond the orifice layer of the fluid ejecting substrate and tends to limit the spacing between the printhead and print media. Consequently, there tends to be a limit to the reduction of trajectory error.

In addition to print quality, the printing systems should have high reliability. Two common failure modes that may decrease the reliability of the printhead are: (1) exposure of the interconnect to ink and (2) ink leakage during the shelf life of the printhead. The encapsulant bead may be eroded thereby exposing the interconnect to ink if the printhead is positioned so close to the print media that the encapsulant bead rubs against the print media during printing. The ink tends to corrode the interconnect which ultimately leads to an electrical failure of the printhead thus, making the printhead less reliable.

Conventional inkjet printers employ a cleaning mechanism which includes a wiper that routinely wipes ink residue from the printhead orifice plate. This residue, if sufficient, can either clog the orifices thereby preventing drop ejection or cause misdirected drops. The cleaning mechanism has a predetermined tolerance so that the wiper does not damage the printhead during the cleaning process. However, the wiper tends to be less effective if it is obstructed by a protruding encapsulant bead and could possibly contribute to the erosion of the bead.

A second reliability factor that tends to reduce printhead life relates to environmental conditions that the printhead experiences. Printheads are often exposed to extreme environmental conditions before they are used in a printing system. For example, printheads are often stored in shipping warehouses where temperatures may range from 0–60 degrees Celsius. Or, printheads may be exposed to varying atmospheric pressures during shipping if the printheads are shipped via airplane. In general, conventional printheads are designed to accommodate these extreme conditions without leaking. However, under extreme environmental conditions as previously described, printheads may leak prior to being used in the printing system. In an attempt to remedy this problem, a tape-like material is placed over the orifice layer to further guard against ink leakage and drying of the ink in the orifices. Ideally, the tape-like material adheres evenly to the orifice layer. However, in conventional printheads, the encapsulant bead previously described may inhibit the tape-like material from uniformly adhering to the orifice layer. If the tape-like material does not uniformly adhere to the orifice layer, ink may leak through the orifice layer and damage surrounding objects. Additionally, ink leaking from the printhead may, over time, harden and clog the orifices as well as contaminate other colors of ink contained within the printhead. Furthermore, leaky printheads are perceived by consumers as being defective and inferior.

Accordingly, there is an ever present need for continued improvements to printing systems that are more reliable and capable of producing even higher quality images. These printing systems should be well suited for high volume manufacturing as well as have a low material cost thus further reducing per page printing cost.

SUMMARY OF THE INVENTION

The present invention is a printing system comprising an inkjet printhead responsive to activation signals for ejecting ink onto printing media. The printhead comprises a carrier having an upper surface that defines a recess and a fluid ejecting substrate disposed therein that is configured for establishing electrical and fluidic coupling with the carrier. The fluid ejecting substrate has a generally planar orifice layer disposed opposite the upper surface of carrier. The orifice layer defines a plurality of orifices disposed therein. The printhead has a generally planar contact surface positioned below the orifice layer and an encapsulant that at least partially encapsulates the fluid ejecting substrate and the carrier to form a substantially coplanar surface with the orifice layer.

BRIEF DESCRIPTION OF THE DRAWINGS

FIG. 4(*b*) is a cross section of the fluid ejecting substrate shown in FIG. 3 where the materials used to form the fluid ejecting substrate are shown.

FIG. 6(*b*) is a cross section of the carrier shown in FIG. 6(*a*) where an interconnect formed between the fluid ejecting substrate and carrier is arched.

FIG. 7(*b*) shows a perspective view of FIG. 7(*a*) where a portion of the mold has been removed thereby revealing the planar surface formed between the upper surface of the fluid ejecting substrate and the upper surface of the carrier.

FIG. 8(*b*) is a cross section of the present invention where the fluid ejecting substrate is encapsulated within the carrier thereby creating an upper substantially planner surface.

DETAILED DESCRIPTION OF THE PREFERRED EMBODIMENT

Figure 1:
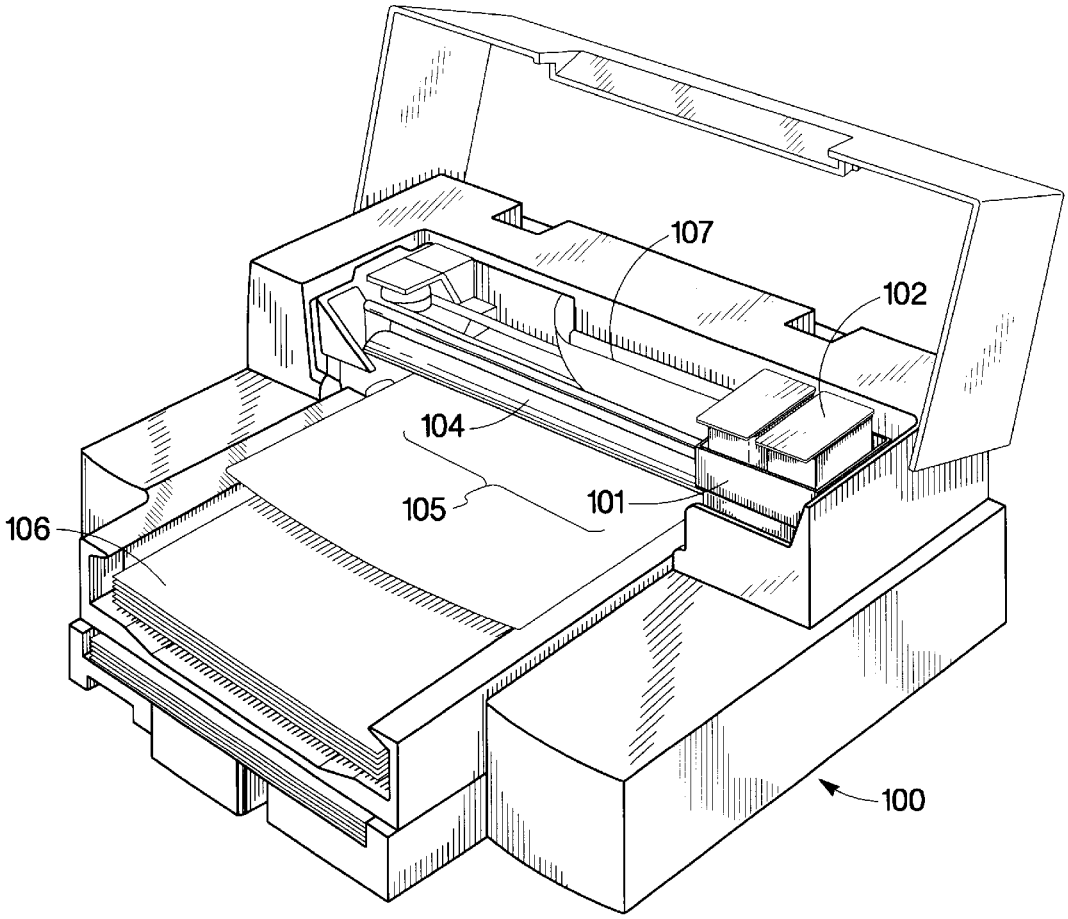
FIG. 1 is a perspective view of one exemplary embodiment of a printing system wherein a printhead is translated across a print media to accomplish printing.

FIG. 1 shows an exemplary embodiment of a printing system 100 that includes a printhead 102 of the present invention. The printing system 100 includes a carriage 101 capable of supporting one or more printhead 102. The carriage 101 is affixed to a carriage support member 104 which supports the printhead 102 as the printhead 102 is moved though a print zone. Collectively, the carriage 101 and carriage support member 104 are the printhead positioning member 105. As the printhead 102 is moved though the print zone, print media 106 is simultaneously stepped through the print zone. The printhead 102 receives activation signals from the printing system 100 via interconnect 107 for selectively ejecting ink droplets onto the print media 106 while the printhead 102 is moved through the print zone. Alternatively, the printhead 102 may be stationary and the print media 106 moved relative to the printhead 102 to achieve printing. Whereas printing system 100 shown in FIG. 1 is formatted to print on 8½ by 11 inch print media, those skilled in the art will appreciate that printing system 100 and the printhead 102 are equally well suited to a wide variety of other printing environments, such as large format printing and textile printing to name a few.

Figure 2:
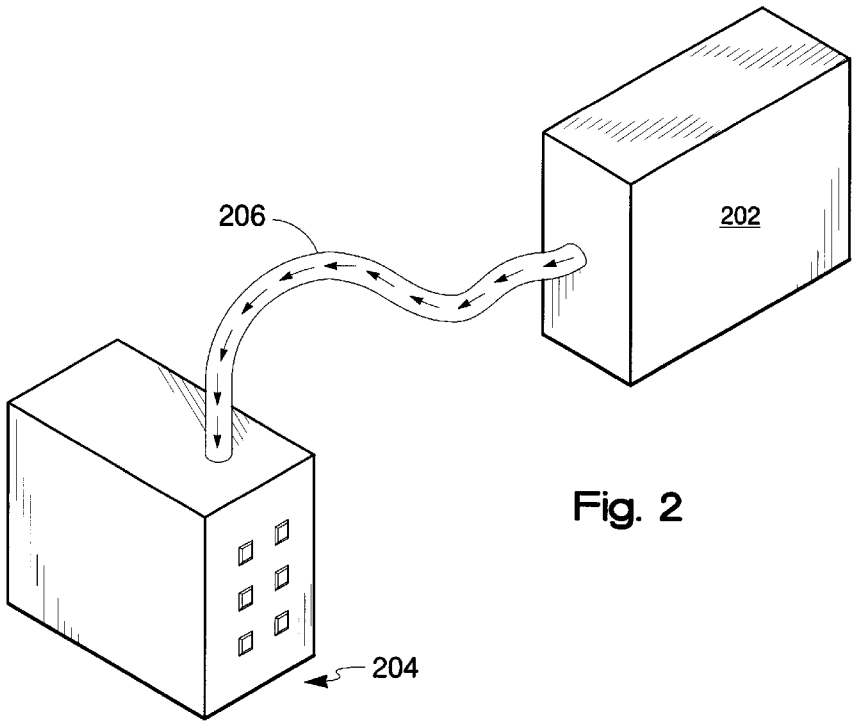
FIG. 2 is a schematic representation of a printing system comprising the printhead and a fluid reservoir for replenishing the printhead.

FIG. 2 shows a schematic representation of a printing system incorporating a preferred embodiment of printhead 102 of the present invention. The printing system includes a fluid reservoir 202 that is fluidically coupled to a printhead 204 wherein ink is ejected from the bottom side (not shown) of printhead 204. The printhead 204 is connected to the fluid reservoir 202 via a fluid conduit 206. The fluid conduit 206 is formed of a flexible material that allows ink to continuously flow to the printhead 204 as the printhead 204 is moved across the print media. The printing system shown in FIG. 2 offers the advantage of having a separately replaceable fluid reservoir 202. Thus, when ink contained in the fluid reservoir 202 is depleted, the fluid reservoir 202 can be replaced without replacing the printhead 204. Alternatively, the printhead 204 can be replaced independent of the fluid reservoir 202.

Figure 3:
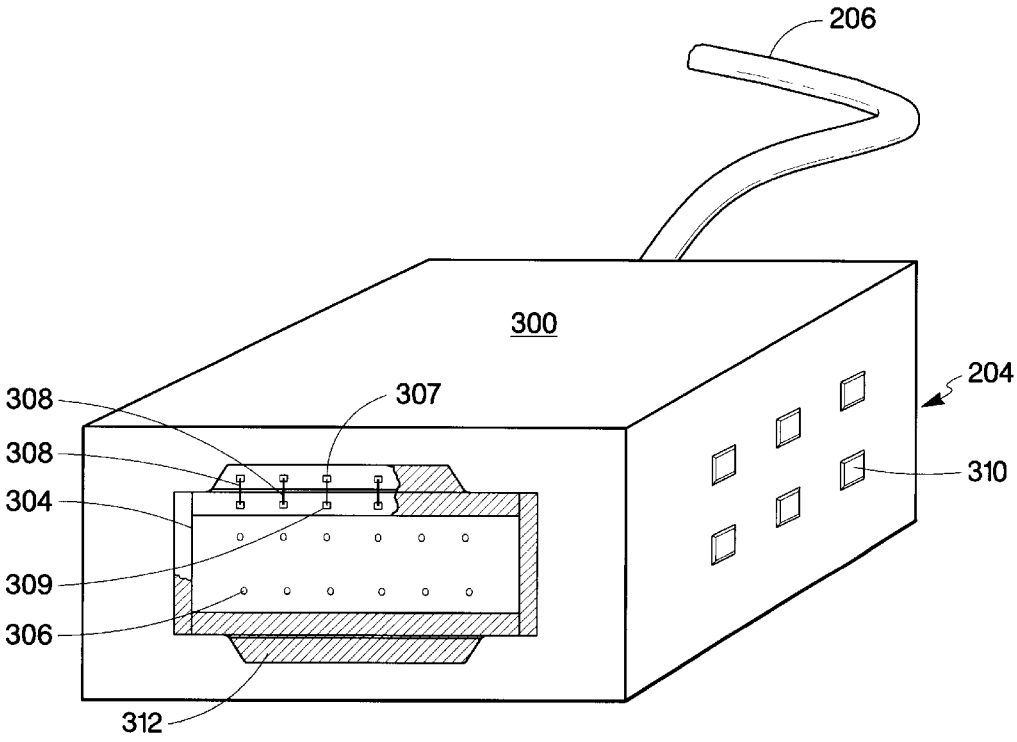
FIG. 3 is a bottom perspective view of the preferred printhead of the present invention that includes a carrier and a fluid ejecting substrate mounted in the carrier.

FIG. 3 shows a bottom perspective view of printhead 204 previously shown in FIG. 2. The printhead 204 has been oriented such that the bottom portion of the printhead 204 from which ink is ejected is visible. The printhead 204 includes a carrier 300 and a fluid ejecting substrate 304. The fluid ejecting substrate 304 is formed of a semiconductor material and has a plurality of orifices 306 defined in an orifice layer. Ink is ejected through the orifices 306 and onto a print media to accomplish printing. Additionally, the fluid ejecting substrate 304 is electrically coupled to the carrier 300 via electrical interconnect 308 which supplies excitation signals to the fluid ejecting substrate 304. The electrical interconnect 308 electrically connects electrical connectors 307 formed in the carrier 300 to electrical contacts 309 formed on the fluid ejecting substrate 304. In the present invention, electrical interconnect 308 is formed of gold wire however, other electrical conductors such as copper, aluminum, or silver to name a few, may also be used.

When the printhead 204 is inserted into the carriage 101 of printing system 100, the electrical contact pads 310 contact adjacent electrical contact pads formed within the carriage 101 thereby forming an electrical connection between the printing system 100 and printhead 204. Electrical interconnects 308 and a portion of fluid ejecting substrate 304 are encapsulated with an encapsulant 312. The encapsulant 312, as will be discussed in greater detail shortly, is configured to prevent ink from contaminating the electrical interconnect 308.

Figure 4A:
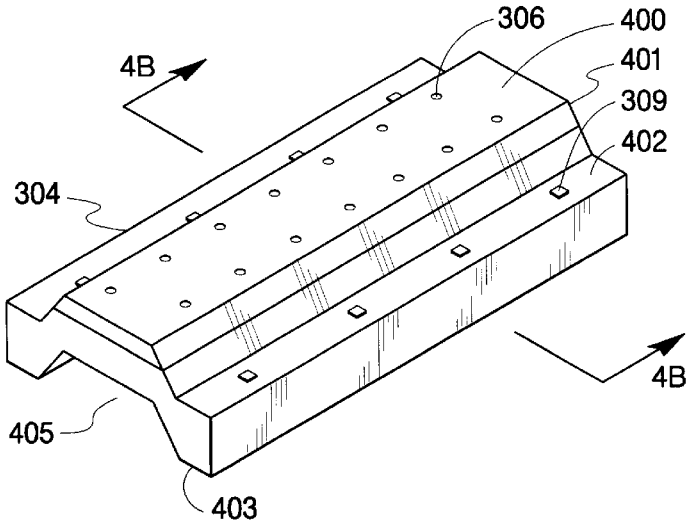
FIG. 4(*a*) is a bottom perspective view of the fluid ejecting substrate shown in FIG. 3 independent of the carrier.
Figure 4B:
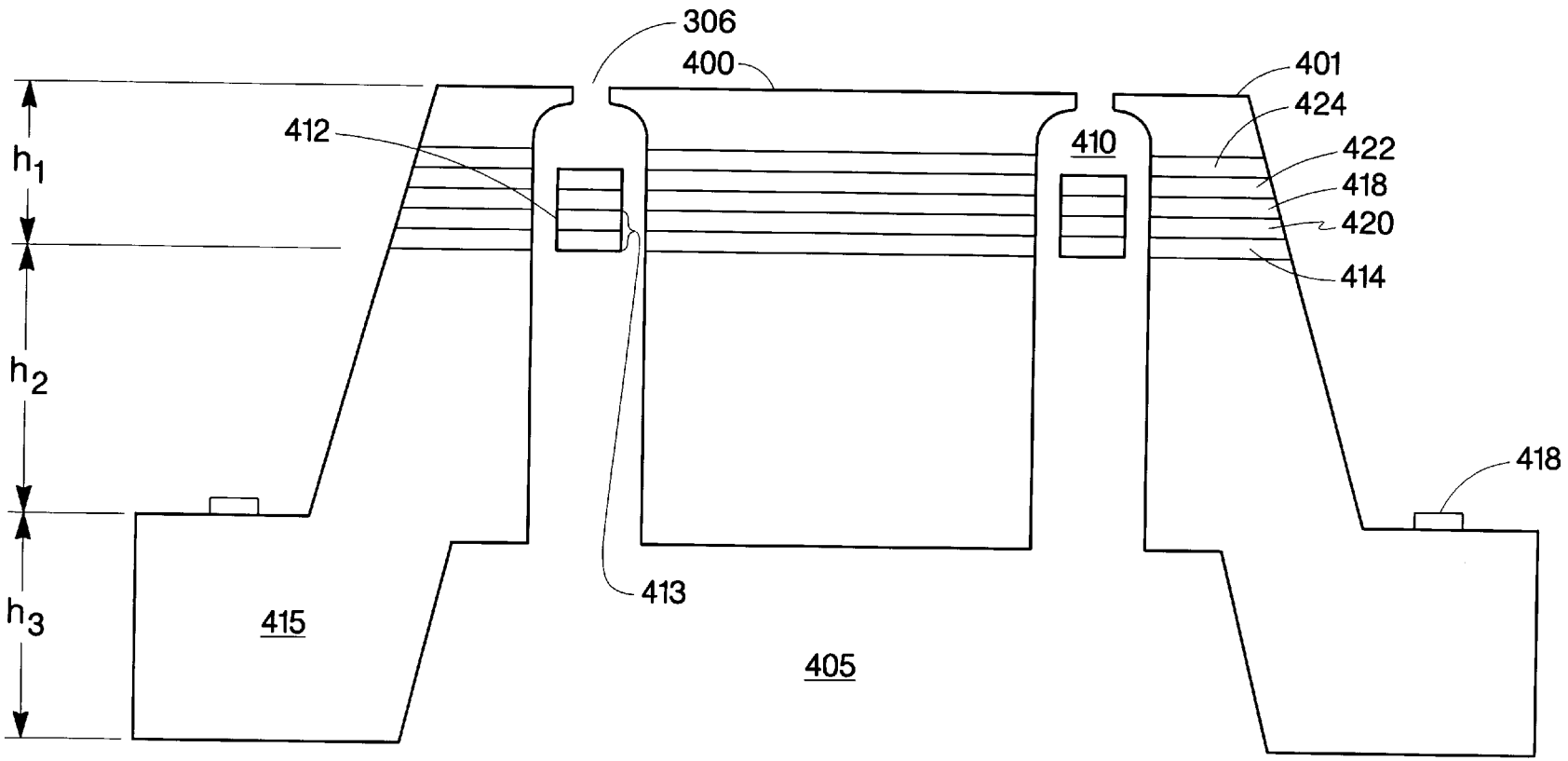

FIG. 4(*a*) is a perspective view of fluid ejecting substrate 304 shown in FIG. 3 independent of carrier 300. The fluid ejecting substrate 304 has a first planar surface 400, a second planar surface 402 and a bottom surface 403. The first planar surface 400 has a plurality of orifices 306 defined in an orifice layer 401. The second planar surface 402, commonly referred to as a contact surface, has eight electrical contacts 309 although more or less electrical contacts 309 may be formed on second planar surface 402 depending on the particulars of the printhead. For example, the number of electrical contacts 309 tend to vary with the number of orifices 306, number of signal lines, and multiplexing scheme of the printing system. The electrical contacts 309 are formed of an electrically conductive material such as aluminum or gold. The bottom surface 403 of the fluid ejecting substrate 304 contains a fluid channel 405. Fluid from fluid channel 405 is channeled to the heater resistors (not shown) and selectively ejected through orifices 306 formed in the orifice layer 401.

FIG. 4(*b*) shows a greatly enlarged cross section of a preferred embodiment of fluid ejecting substrate 304 shown in FIG. 4(*a*). The fluid ejecting substrate 304 further comprises an ink chamber 410 and heater resistors 412. Ink received from carrier 300 flows into the fluid channel 405 of the fluid ejecting substrate 304. The ink is then channeled into an ink chamber 410 where the ink resides on top of heater resistors 412 located at the base 413 of the ink chamber 410. The heater resistors 412 receive excitation signals through electrical interconnects 308 (not shown) and subsequently eject ink through the orifice(s) 306.

The fluid ejecting substrate 304 of FIG. 4(*b*) is made of several materials that are sequentially layered to form a high quality, reliable printhead. Each layer has a predetermined thickness and a unique function. First, a semiconductor substrate 415 is provided that is approximately 0.6 mm thick. Next, a 1.2 $\mu$m thick oxide layer 414 is formed on top of the semiconductor substrate 415 to insulate the semiconductor substrate 415 from the forthcoming metal layers. The metal layers, formed on top of the oxide layer 414 consist of Aluminum (Al) 418 and Tantalum Aluminum (TaAl) 420 respectively. The metal layers are used to form the heater resistors 412 formed of a resistive material such as tantalum aluminum 420 and signal lines made of aluminum 418. In the preferred embodiment, the combined thickness of the metal layers is 1.2 $\mu$m. Next, a 0.4 $\mu$m thick passivation layer 422 is formed on top of the metal layers. The passivation layer 422 prevents ink, being channeled to heater resistors 412, from attacking the metal layers. An additional layer of protection, commonly referred to as a cavitation layer 424, is formed on top of the passivation layer 422. The cavitation layer 424 is made of Ta and ranges in thickness between 0.1 um and 0.8 um. An orifice layer 401 is then formed on top of the Ta layer 424. The orifice layer 401 is typically 40 $\mu$m thick although a lesser or thicker orifice layer may be used.

Figure 5:
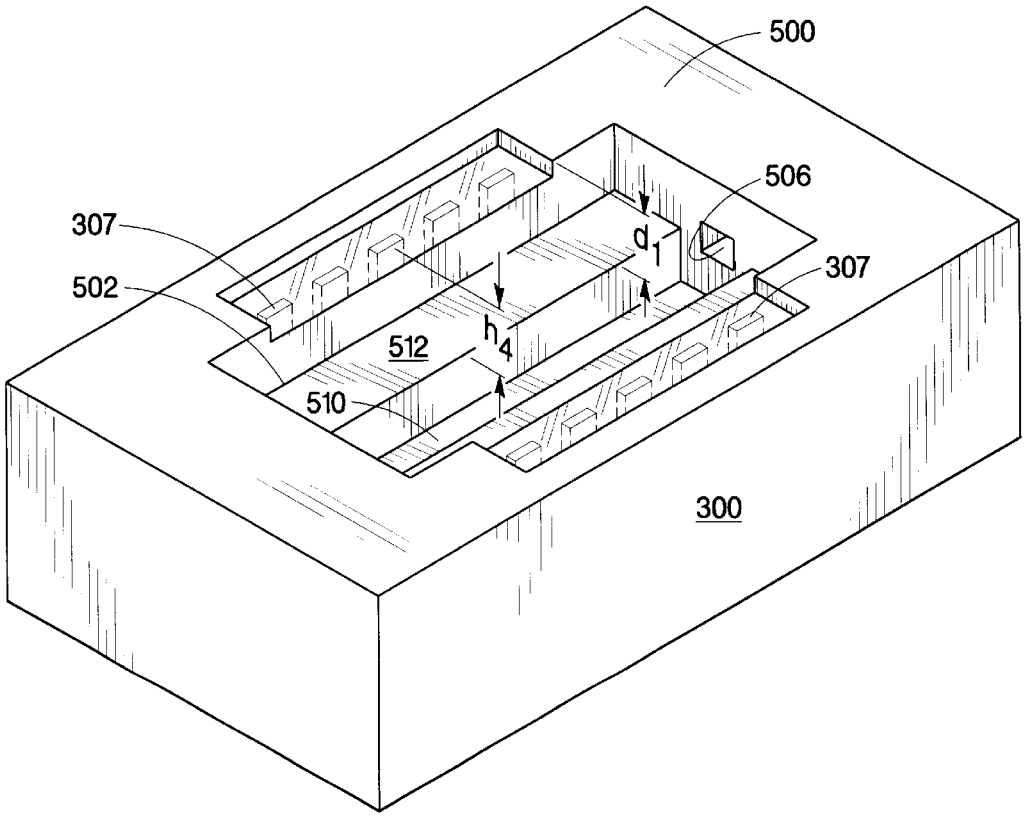
FIG. 5 is a bottom perspective view in isolation of the carrier shown in FIG. 3 configured to receive a fluid ejecting substrate; the carrier receives ink from the fluid reservoir and channels ink to the fluid ejecting substrate.

FIG. 5 shows a perspective view of carrier 300 having an upper surface 500 and a countersunk recess 502 therein. The countersunk recess 502 is sized to accommodate the fluid ejecting substrate 304. In a preferred embodiment, the countersunk recess 502 has a recess bevel depth indicated by reference character "d1". Recess bevel depth dl extends from upper surface 500 to inner lower surface 512 of carrier 300. The counter sunk recess 502 contains electrical connectors 307 which receives excitation signals (not shown) from the printing system. The electrical connector 307 resides above the inner lower surface 512 by an electrical connector height designated by reference character "h4". The number of electrical connectors 307 typically correspond to the number of electrical contacts 309 on fluid ejecting substrate 304. The carrier 300 also contains an aperture 506 that is coupled to fluid reservoir 202 shown in FIG. 2. Ink flowing in aperture 506 inters a channel 510 on top of which fluid channel 405 of fluid ejecting substrate 304 resides. In a preferred embodiment of the present invention, carrier 300 is formed of molded plastic, however, other materials could be used to form the carrier 300 including ceramic, metal, and carbon composites.

Figure 6A:
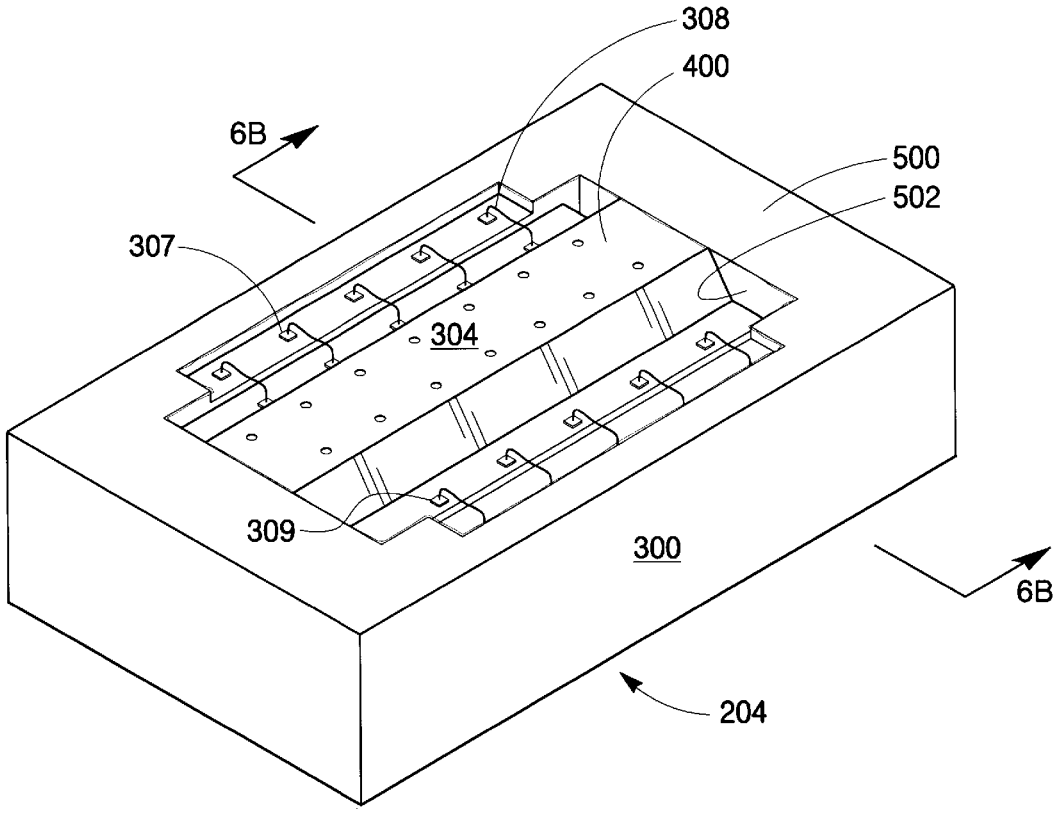
FIG. 6(*a*) is a perspective view of a carrier with the fluid ejecting substrate inserted therein; the fluid ejecting substrate is electrically and fluidically coupled to the carrier.
Figure 6B:
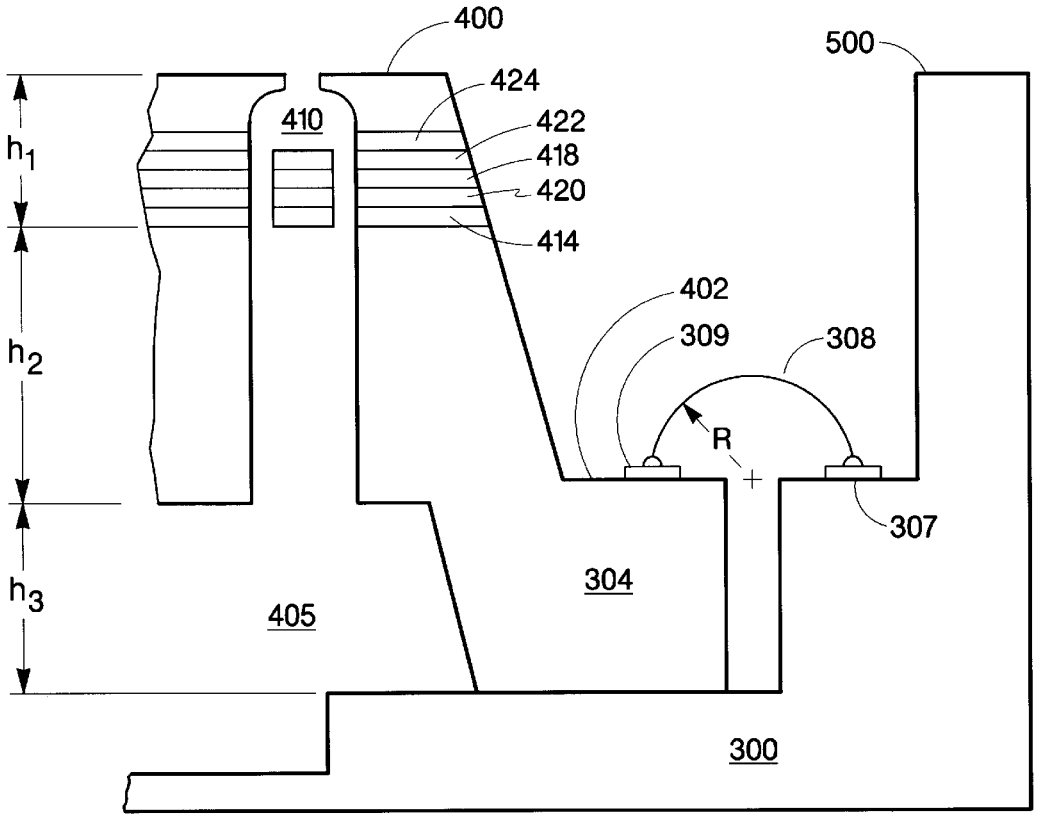

FIG. 6(*a*) shows carrier 300 having fluid ejecting substrate 304 inserted into the countersunk recess 502. The second planar surface height designated by reference character "h3" shown in FIG. 4(*b*) is chosen such that when the fluid ejecting substrate 304 is inserted into the carrier 300, second planar surface height h2 and electrical connector height designated by reference character "h4" align. Additionally, bevel height h2 is chosen such that first planar surface 400 of fluid ejecting substrate 304 and upper surface 500 of carrier 300 align as well. Alternatively, first planar surface 400 of fluid ejecting substrate 304 may extend above upper surface 500 of carrier 300. Next, the fluid ejecting substrate 304 is electrically coupled to the carrier 300 via electrical interconnect 308. The electrical interconnect 308 is formed below the first planar surface 400 of the fluid ejecting substrate 304 and upper surface 500 of carrier 300.

FIG. 6(*b*) shows an enlarged cross section of one electrical interconnect 308 formed between the fluid ejecting substrate 304 and carrier 300. The electrical interconnect 308 is wire bonded to the electrical connector 307 and electrical contact 309 such that the electrical interconnect 308 is arched at a radius indicated by reference character "R" shown in FIG. 6(*b*). Positioning the electrical interconnect 308 as such is a common practice in the semiconductor industry. Forming an arch with the electrical interconnect tends to relieves stress which may otherwise lead to an electrical failure. The radius 602 is typically 100 $\mu$m and is less than the film stack height indicated by reference character h1 shown in FIG. 4(*b*) which typically equals 41 $\mu$m.

To ensure that the arched electrical interconnect 308 does not extend beyond the first planar surface 400 of the fluid ejecting substrate 304, a bevel height indicated by reference character "h2" shown in FIG. 6(*b*) is increased. Increasing bevel height h2 effectively lowers the electrical interconnect 308 relative to first planar surface 400. Perhaps most significantly, the value of bevel height h2, which is typically 150 $\mu$m, can be chosen such that first planer surface 400 extends beyond the upper surface 500 of the carrier 300 while the arch of the electrical interconnect 308 resides below the upper surface 500 of carrier 300. Alternatively, the value of bevel height h2 may be chosen such that first planar surface 400 and upper surface 500 reside in the same plane while the arch of the electrical interconnect 308 resides below the upper surface 500. Although in an embodiment of the present invention, a wire bond was used, a TAB circuit, which typically has a thickness greater than height h1 may be used as well.

Figure 7A:
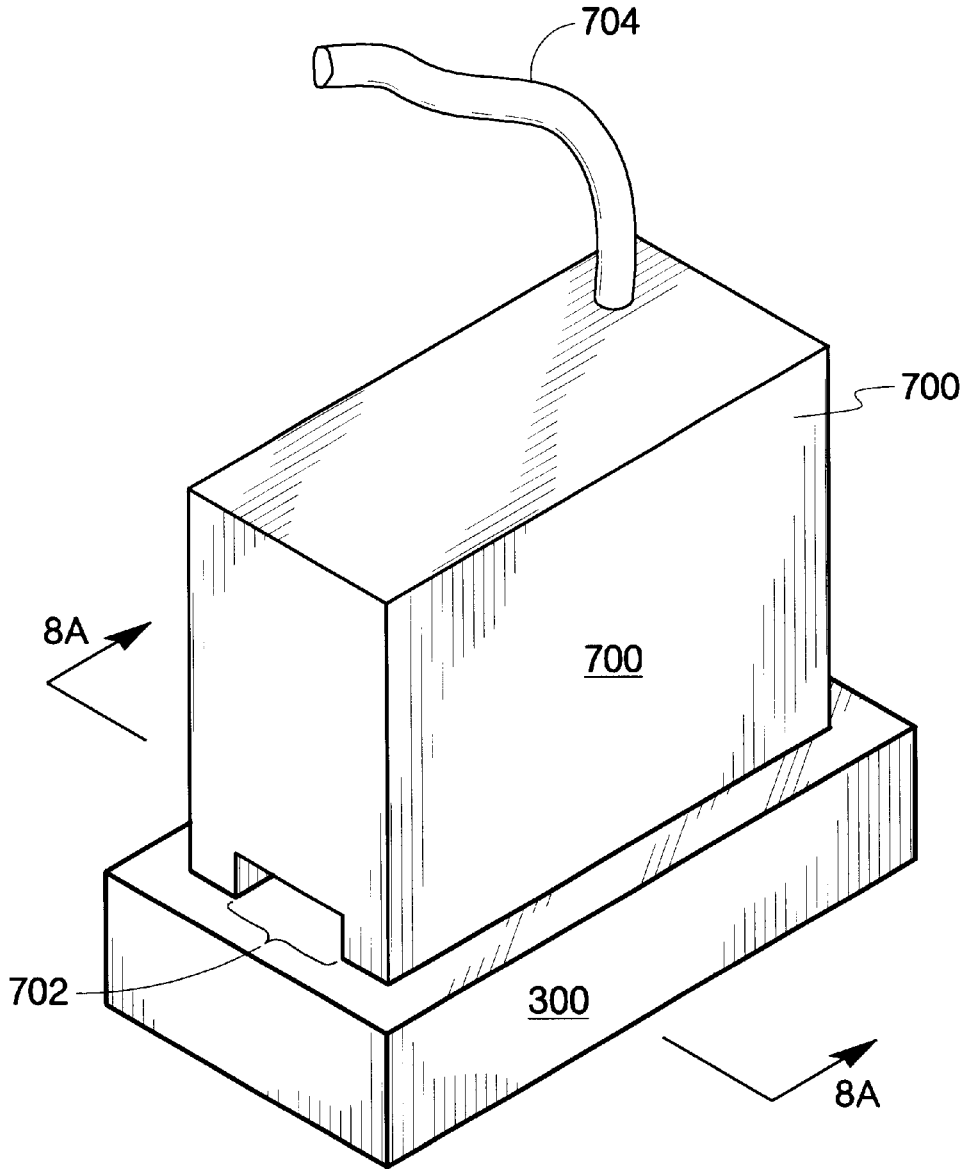
FIG. 7(*a*) shows a perspective view of a mold configured to inject an encapsulant into selective regions of a countersunk recess formed in an upper surface of the carrier once the fluid ejecting substrate is inserted into the countersunk recess.
Figure 7B:
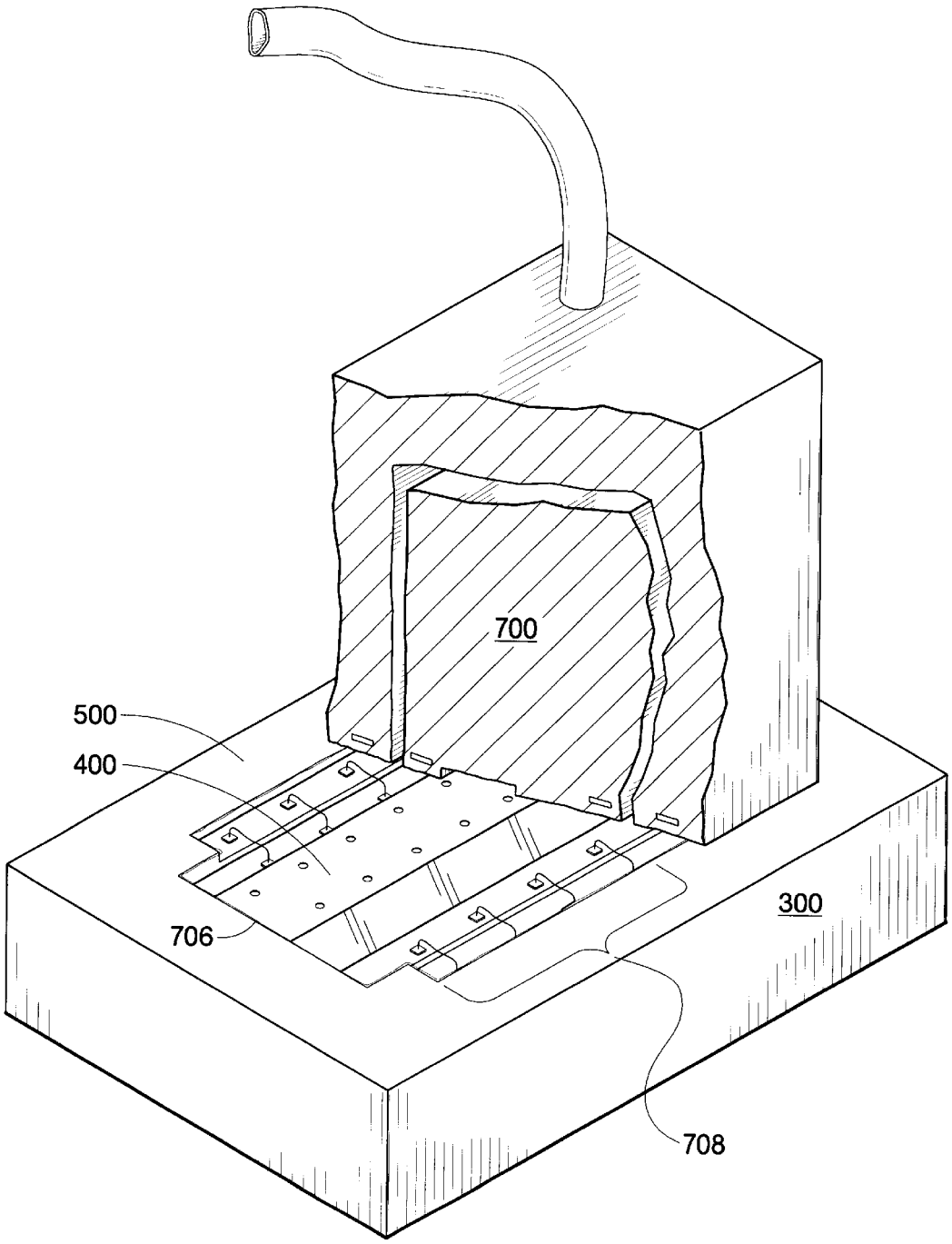

FIG. 7(*a*) shows a mold 700 being used to dispose the encapsulant 312 in selected areas of carrier 300. The encapsulant 312 is supplied to mold 700 in liquid form through inlet 704. Additionally, a groove 702 is formed in mold 700, thereby preventing the orifice layer 401 beneath mold 700 from being damaged when mold 700 is brought in contact with the carrier 300. FIG. 7(*b*) shows a perspective view of FIG. 7(*a*) where a portion of mold 700 has been removed thereby revealing the planar surface formed between first planar surface 400 of fluid ejecting substrate 304 and upper surface 500 of carrier 300. The encapsulant 312 is selectively disposed into two areas of carrier 300. First, the encapsulant 312 is disposed in seams 706 created adjacent to the fluid ejecting substrate 304 and the countersunk recess 502 following the insertion of the fluid ejecting substrate 304. Second, the encapsulant 312 is disposed in an interconnect region 708 of the fluid ejecting substrate 304.

Figure 8A:
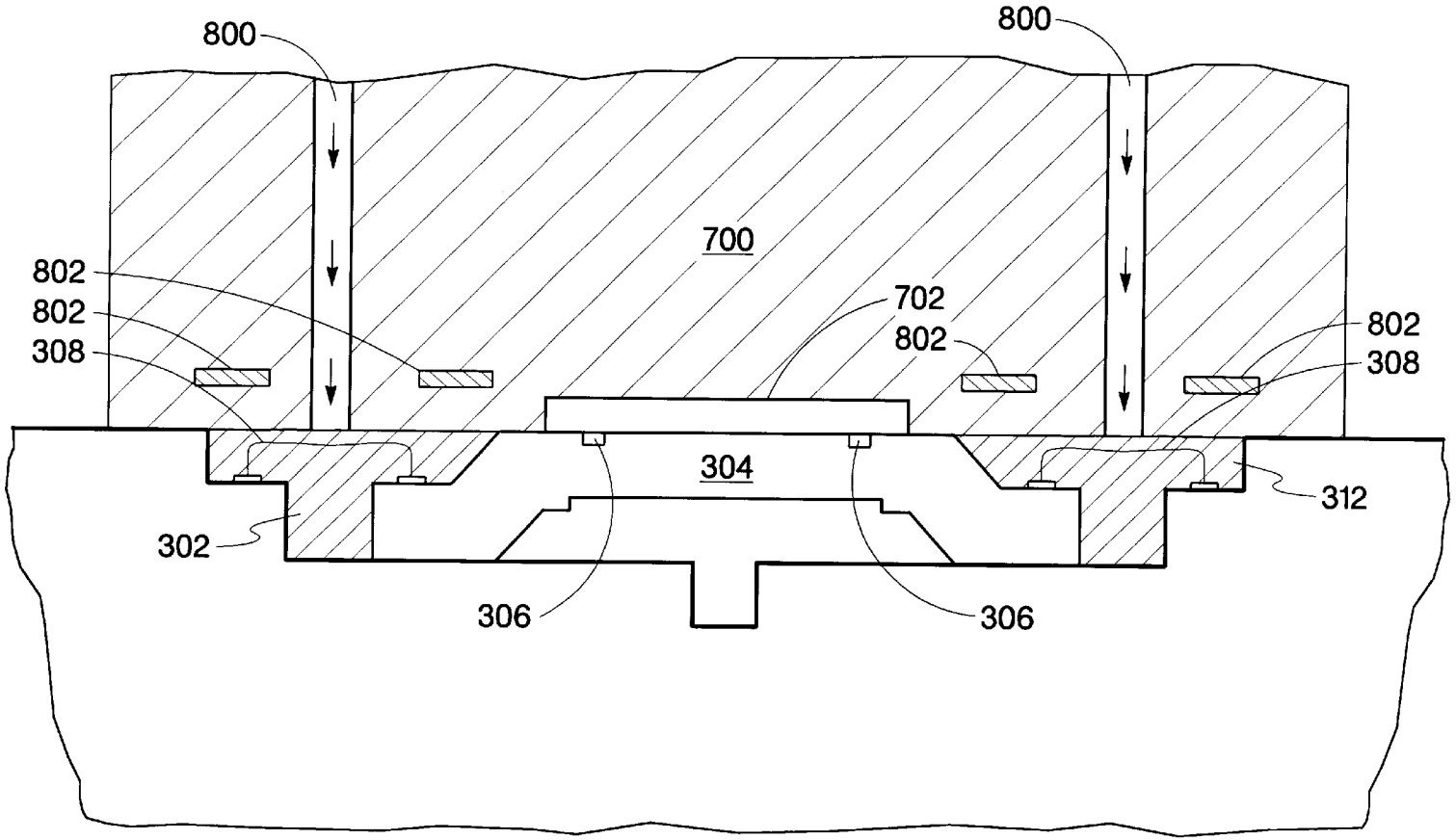
FIG. 8(*a*) is a cross-section of FIG. 7 showing the mold, fluid ejecting substrate, and carrier as the encapsulant is injected into the carrier.
Figure 8B:
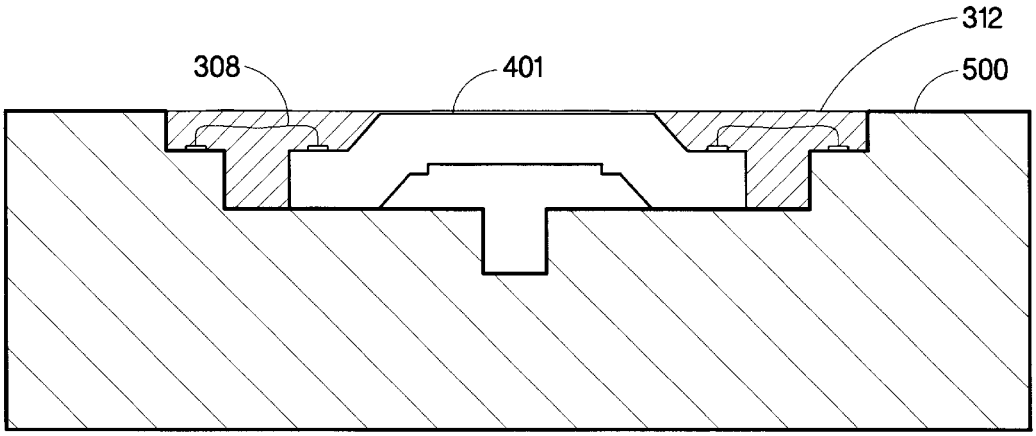

FIG. 8(*a*) shows a cross section of FIG. 7(*a*) where mold 700 is put in contact with carrier 300. The encapsulant 312 is injected into the carrier 300 through channels 800 or alternatively, the encapsulant 312 is drawn into carrier 300 through channels 800 via capillary action. While the encapsulant 312 is dispensed onto the carrier 300 through mold 700, the encapsulant 312 is isolated from the orifice layer 401. Shielding the encapsulant 312 from the orifice layer 401 is important because the encapsulant 312, if exposed to the orifice layer 401, will permanently clog the orifices 306 formed therein. Once the encapsulant 312 has been dispensed, the encapsulant 312 dries at ambient temperature or is externally heated to accelerate the drying/curing process. Additionally, ultraviolet light may be used to cure the encapsulant as well. In a preferred embodiment of the present invention, the curing of the encapsulant 312 is accelerated by heating coils 802 formed within mold 700.

FIG. 8(*b*) shows a preferred embodiment of the present invention where the encapsulant 312 has been injected into the carrier 300 and mold 700 has been removed. The encapsulant 312 further planarizes the upper surface 500 of the carrier 300 and prevents ink on the orifice layer of the fluid ejecting substrate from reaching the electrical interconnect 308. Consequently, damage to the electrical interconnect 308 by the ink is eliminated. Furthermore, since the electrical interconnect 308 is formed below the first planar surface of the fluid ejecting substrate 304 prior to the formation of the encapsulant 312, the encapsulant bead prevalent in conventional printheads is eliminated. By eliminating the encapsulant bead, the printhead 204 of the present invention is operated in close proximity of the print media. In one embodiment, the encapsulant 312 allows the printhead positioning member 105 to position the orifice layer within 0.5 millimeters of the print media. Consequently, trajectory errors and parasitic effects inherent to the printing environment are minimized thereby improving print quality.

Previous attempts have been made to improve the reliability of printheads. For example, U.S. Pat. No. 4,873,622 to Komuro, et al., entitled "Liquid Jet Recording Head" describes a pressure transfer molding technique used to form a recording head. The recording head contains a discharge element having a membrane disposed thereon from which ink is ejected onto a print media. The discharge element is electrically coupled to a metal frame. The electrical connection is made on top of the discharge element and an epoxy is molded around the electrical connection and recording head. The membrane is recessed within the molded epoxy.

In the present invention, makes use of a stepped die so that the electrical connection is formed sufficiently below the orifice layer so that the encapsulant can be formed in the same plane as the orifice layer. The encapsulant of the present invention is in plane with the orifice layer in contrast to the Komuro reference where the membrane is recessed within the molded epoxy and therefore, the printhead of the present invention allows the orifice layer to be positioned closer to print media than the membrane of Komuro. Positioning the orifice layer closer to the print media allows trajectory error to be reduced. In addition, the printhead of the present invention provides a planar printhead surface that is readily cleaned in contrast to Komuro that has a recording head structure with a recess that tends to trap ink residue and debris and is harder to clean using conventional wiping technology.

What is claimed is:

1. A fluid ejection device capable of ejecting fluid onto media comprising:

a carrier having an upper surface that defines a recess;

a fluid ejecting substrate disposed therein that is configured for establishing electrical and fluidic coupling with the carrier, the fluid ejecting substrate having a generally planar orifice layer defining a plurality of orifices therein and a generally planar contact surface positioned below the orifice layer; and an encapsulant that at least partially encapsulates the fluid ejecting substrate and the carrier to form a surface that is coplanar with the orifice layer.

2. The device of claim 1 wherein the fluid ejecting substrate is configured for receiving fluid from the carrier.

3. The device of claim 1 wherein the encapsulant is formed adjacent the orifice layer.

4. The device of claim 1 wherein the carrier comprises an electrical connector, the electrical connector being electrically coupled to the fluid ejecting substrate at a location below the surface that is coplanar with the orifice layer.

5. The device of claim 1 wherein the carrier comprises a channel, the channel is formed in an inner lower surface of the carrier and is fluidically coupled to a fluid reservoir.

6. The device of claim 1 wherein the encapsulant is molded onto the carrier and fluid ejecting substrate via injection.

7. The device of claim 1 wherein the contact surface is electrically coupled to the carrier via an electrical interconnect, the electrical interconnect is positioned below the orifice layer of the fluid ejecting substrate.

8. The device of claim 1 wherein the recess formed in the upper surface of the carrier is countersunk thereby forming a countersunk recess, the carrier further comprises an inner lower surface configured to support the fluid ejecting substrate.

9. The device of claim 8 wherein a portion of the countersunk recess comprises electrical connectors formed therein.

10. The device of claim 1 wherein the surface that is coplanar with the orifice layer is contiguous with the orifice layer.

11. The device of claim 1 where the recess is stepped.

12. A printing system for close proximate printing with print media, the printing system having a fluid reservoir configured to supply fluid to a printhead for ejecting fluid onto the print media through orifices formed in an orifice layer disposed on a fluid ejecting substrate, the printing system comprising:

a printhead positioning member that positions the printhead relative to the print media; and a molded encapsulant formed coplanar with the orifice layer thereby allowing the printhead positioning member to position the orifice layer within 0.5 millimeters of the print media.

13. The printing system of claim 12 where the printhead is electrically coupled via an electrical coupling to the printing system through at least one electrical contact pad.

14. The printing system of claim 13 wherein a portion of the electrical coupling to the printhead is formed beneath the molded encapsulant.

15. An inkjet printhead responsive to activation signals for ejecting ink onto media comprising:

a carrier having an upper surface that defines a recess, wherein the recess formed in the upper surface of the carrier is countersunk thereby forming a countersunk recess, wherein a portion of the countersunk recess comprises electrical connectors formed therein;

a fluid ejecting substrate disposed therein that is configured for establishing electrical and fluidic coupling with the carrier, the fluid ejecting substrate having a generally planar orifice layer defining a plurality of orifices therein and a generally planar contact surface positioned below the orifice layer; and an encapsulant that at least partially encapsulates the fluid ejecting substrate and the carrier to form a substantially co-planar surface with the orifice layer, wherein the carrier further comprises an inner lower surface configured to support the fluid ejecting substrate, wherein the portion of the countersunk recess comprising the electrical connectors is positioned below the upper surface of the carrier and has a predetermined depth chosen to substantially equal the height of the contact surface of the fluid ejecting substrate.

16. The print head of claim 15 wherein the contact surface of the fluid ejecting substrate comprises electrical contacts for receiving activation signals from a printing system via the carrier, the contact surface has a predetermined height chosen to substantially equal the predetermined depth of the portion of the countersunk recess comprising the electrical connectors.

* * * * *